United States Patent [19]

Simcock

[11] Patent Number: 4,927,460

[45] Date of Patent: May 22, 1990

[54] INDUCTION MELTING AND STIRRING

[75] Inventor: John H. Simcock, Droitwich, United Kingdom

[73] Assignee: Inductotherm Europe Limited, Hereford & Worcester, United Kingdom

[21] Appl. No.: 333,356

[22] Filed: Apr. 4, 1989

Related U.S. Application Data

[62] Division of Ser. No. 144,367, Jan. 15, 1988, Pat. No. 4,850,573.

[30] Foreign Application Priority Data

Feb. 14, 1987 [GB] United Kingdom ..... 8703488

[51] Int. Cl.[5] ..... C21C 7/00

[52] U.S. Cl. ..... 75/10.14; 75/10.16; 266/234

[58] Field of Search ..... 75/10.14–10.18, 75/61, 93 R; 266/234

[56] References Cited

U.S. PATENT DOCUMENTS

| | | | |
|---|---|---|---|
| 1,983,242 | 12/1934 | Rohn | 13/27 |
| 3,014,255 | 12/1961 | Bussard et al. | 22/209 |
| 3,020,323 | 2/1962 | Redfern | 266/234 |
| 3,314,670 | 4/1967 | Kennedy | 266/234 |
| 3,396,229 | 8/1968 | Sundberg | 266/234 |
| 3,443,806 | 5/1969 | Galey | 266/234 |
| 3,579,324 | 5/1971 | Kennedy | 75/10.14 |
| 3,767,831 | 10/1973 | Plockinger et al. | 13/12 |
| 3,875,322 | 4/1975 | Sundberg | 13/27 |
| 4,499,583 | 2/1985 | Mulcahy | 373/161 |
| 4,695,316 | 9/1987 | Cartlidge | 75/10.14 |

OTHER PUBLICATIONS

R. J. Fruehan, "Ladle Refining Furnances for the Steel Industry", Report Prepared for the Center of Metals Production, Mar. 1985.

*Primary Examiner*—Peter D. Rosenberg

*Attorney, Agent, or Firm*—Seidel, Gonda, Lavorgna & Monaco

[57] ABSTRACT

Method of and apparatus for providing agitation of the melt in the induction melting of metals. A medium frequency melting power supply (12) of an induction furnace or crucible (10) acts in conjunction with a modulating circuit incorporating a wave form generator (14) whereby modulation at predetermined amplitude and frequency is applied to the furnace power frequency during at least part of the melt processing cycle to cause agitation of the melt to a predetermined extent independently of the selected overall power input.

11 Claims, 7 Drawing Sheets

INDUCTION MELTING AND STIRRING

Figure 1:
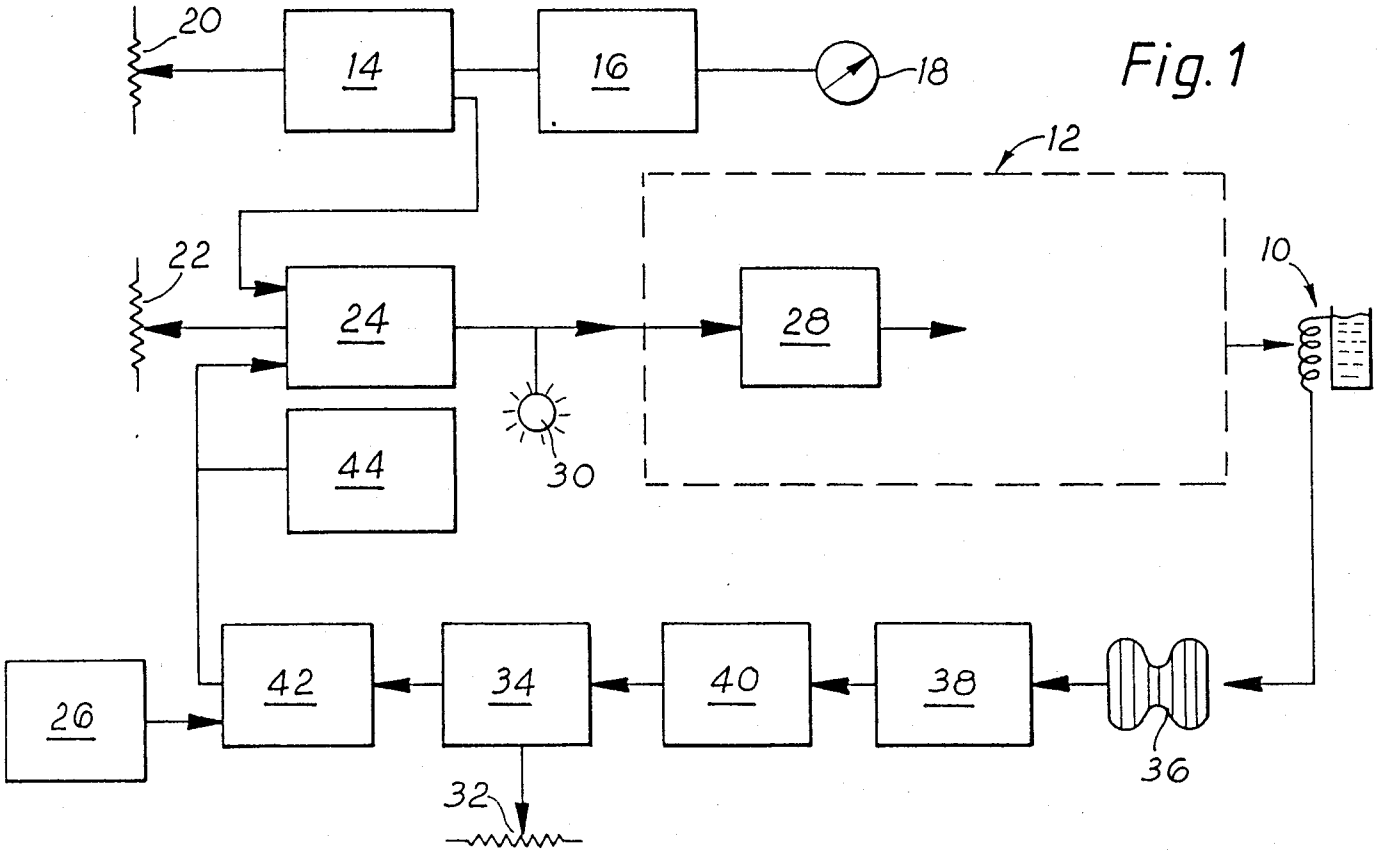

This application is a division of copending application Ser. No. 07/144,376 filed Jan. 15, 1988 U.S. Pat. No. 4,850,573.

This invention relates to induction melting.

It is often a requirement in induction melting, particularly but not exclusively the melting of steels and other high temperature alloys in vacuum, to hold the molten bath at a constant preselected temperature and, at the same time, provide agitation of the melt to a required degree. This agitation or stirring is required for ensuring a homogeneous mixture, e.g. when alloying but in many known types of medium frequency induction furnaces the power input to hold the desired temperature does not product sufficient movement of the melt to ensure adequate agitation.

The object of the invention is to provide a method of an apparatus for induction melting having particularly effective agitation combined with the ability to hold the temperature of the melt at the desired level; which is economical to provide and operate; and which is easily and reliably controlled.

SUMMARY OF THE INVENTION

The present invention relates to a method of and apparatus for induction melting comprising a vessel for holding a molten metal bath, an induction coil means operatively associated with the vessel, a power supply means for providing power to the induction coil means at a first frequency for holding the molten metal bath at a preselected temperature by induction heating, and a modulator means for modulating the amplitude of the power to the induction coil means with a modulation signal at the second frequency for agitating the molten metal to a predetermined extent independent of the selected overall power input. The second frequency is approximately equal to the hydrodynamic resonant frequency of the metal bath and can be varied over a preselected range which extends from 0 to 100%. A modulation termination means automatically terminates modulation when the modulation level exceeds a predetermined maximum, while a timer means delays reapplication of modulation following termination due to the predetermined maximum modulation level being exceeded. The timer means may also delay inception of modulation until power from the power supply means has reached a predetermined value, and then gradually apply modulation upon initiation.

According to one aspect of the invention there is provided a method of induction melting including the step of applying modulation at predetermined amplitude and frequency to the power frequency utilised to effect the induction melting during at least part of the melt processing cycle to cause agitation of the melt to a predetermined extent independently of the selected overall power input.

Conveniently the melting power operates at a medium frequency i.e. a frequency in the approximate range from 50 Hz upto 10 kHz and the frequency of the applied modulation may be up to 100 Hz.

The modulation frequency may be adjustable to be at or near the hydrodynamic resonant frequency of the melt to provide most efficient energy transfer thereto.

It is also preferred but not required that the modulation be applied only after a predetermined lapse of time, from the initiation or establishment of power input at the melting frequency. It is also preferred but not required that the modulation be applied generally, e.g. in stages, upto the required level. This avoids undue interference with or malfunctioning of the melting power frequency.

Provision may be made for monitoring the modulation level against a predetermined maximum safe level.

The invention further resides in apparatus for effecting the method or methods referred to above.

Said apparatus may include one or more of the following features.

(a) manual presetting of the modulation amplitude (b) manual presetting of the modulation frequency (c) means for automatically terminating the modulation if the modulation level exceeds a predetermined maximum (d) an automatic time delay for holding inception of the modulation until the melting power at operational frequency is established and/or following switch-off due to exceeding the maximum modulation level; and/or (e) means for gradual establishment of the modulation level on start-up.

According to another aspect of the invention there is provided apparatus for inductively stirring molten metal, comprising:

(a) a vessel for holding a molten metal bath, (b) induction coil means operatively associated with the vessel, (c) power supply means for providing power to the induction coil means at a first preselected frequency for holding the metal bath at a preselected temperature by induction heating, and (d) modulator means for modulating the amplitude of the power to the induction coil means with a modulation signal at a second frequency approximately equal to the hydrodynamic resonant frequency of the metal bath.

The second frequency may be variable, and/or the modulation may be variable from 0 to 100 percent.

Figure 2A:
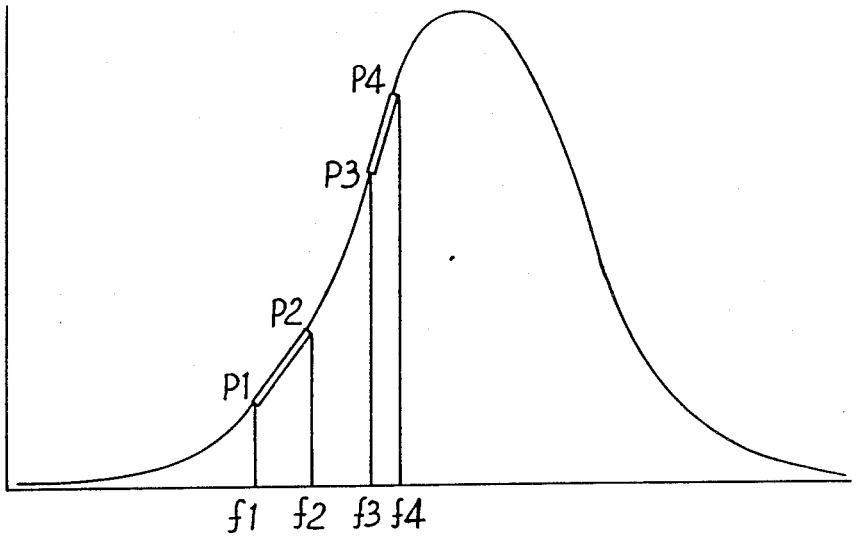
Figure 2B:
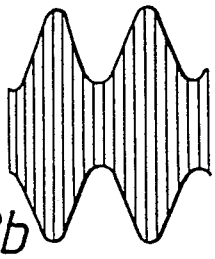
Figure 2C:
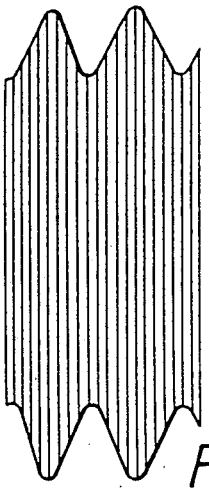
Figure 3A:
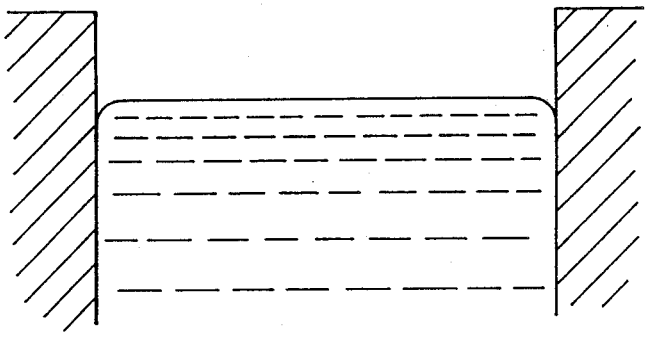
Figure 3B:
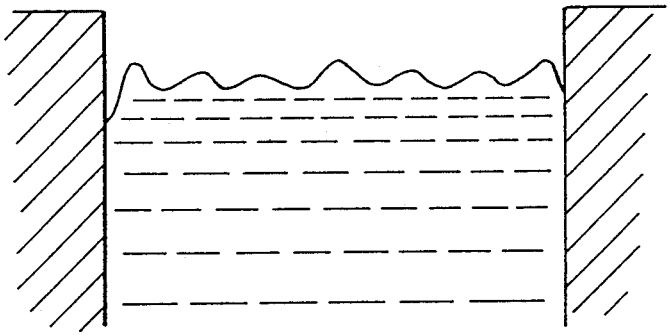
Figures 1, 4A:
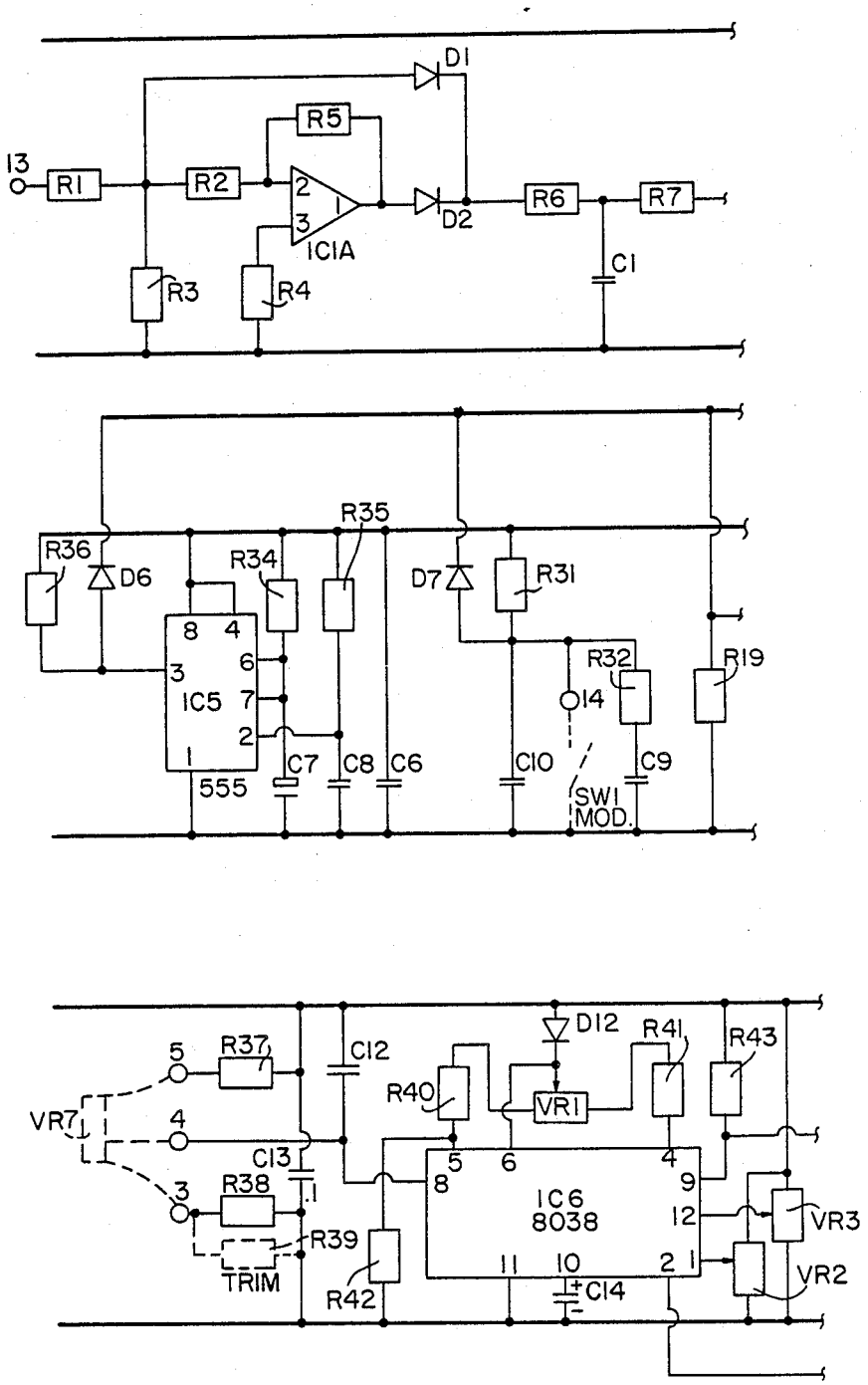

An example of the method and apparatus of the invention is now more particularly described with reference to the accompanying drawings wherein:

FIG. 1 is a block diagram of induction melting apparatus;

FIGS. 2*a–c* are graphic representations of frequency modulation and wave forms associated therewith;

FIGS. 3*a* and *b* are diagrammatic illustrations of the effect of the modulation on the melt bath, and FIGS. 4*a* and *b* are circuit diagrams of an example of a modulating circuit of the invention.

In this example the invention is applied to an otherwise conventional induction furnace or crucible 10 shown diagrammatically in FIG. 1 driven by a mediaum frequency melting power supply 12 i.e. operating in the approximate frequency range of from about 50 Hz to about 10 kHz.

The invention is most conveniently applied to power supply 12 if it is a series resonant system in which the melting power is adjusted by varying the frequency. However it is also contemplated that the invention could be applied to other types of power supply for example parallel resonant systems operating at fixed frequency using variation in voltage to adjust the melting power.

Power supply 12 is typically fed from mains three phase 50 Hz or 60 Hz AC current which is applied by way of a DC stage through an inverter to give the single phase medium frequency furnace power supply.

Figures 2, 4A:
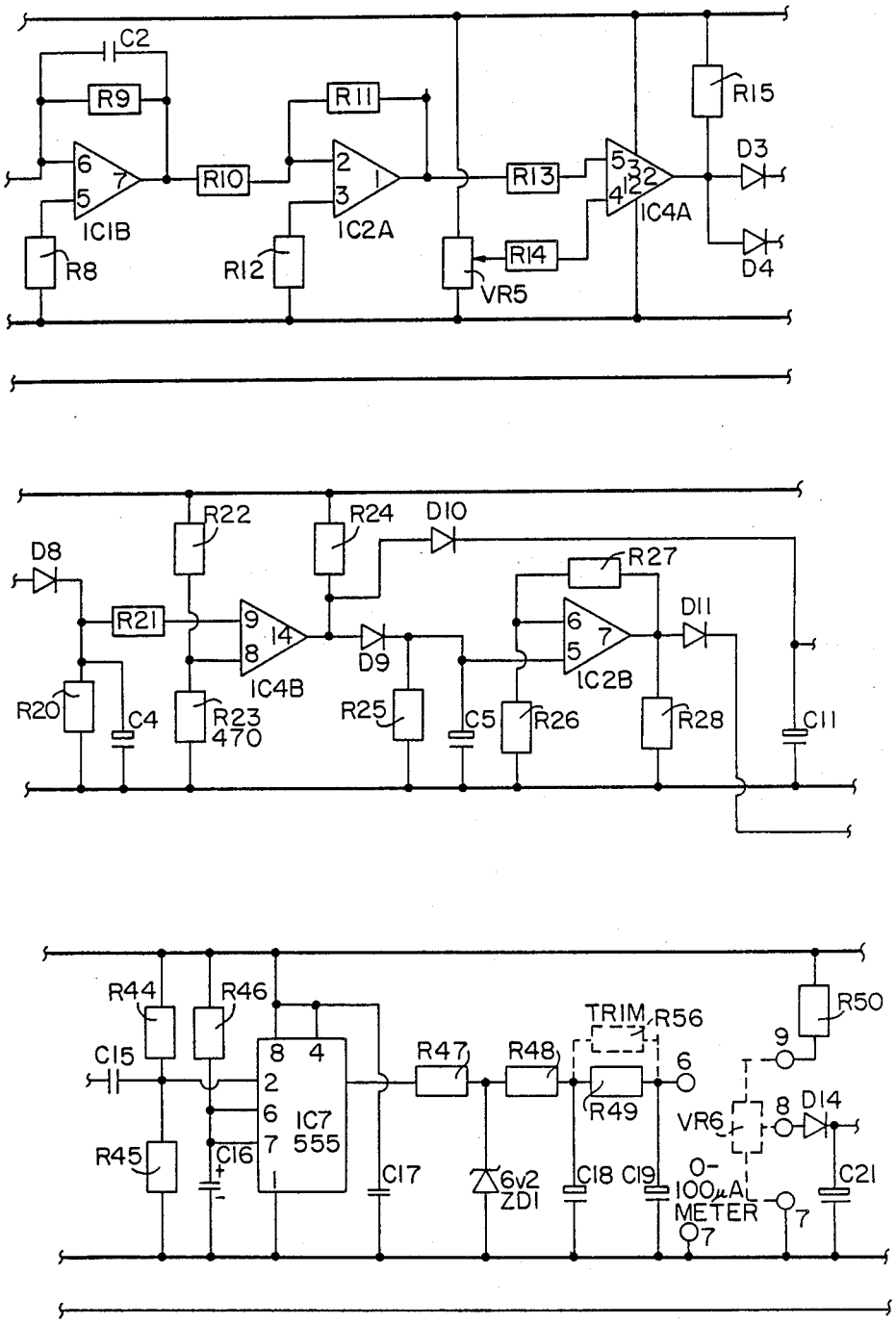

FIG. 2(*a*) illustrates the modulation characteristics of the medium frequency power supply. The frequency versus power characteristic of the furnace coil is a result of combining the inductance of the coil with a capacitor to tune to a resonant frequency. It will be seen that for varying peak power levels, for the same depth of power production P1 to P2 and P3 to P4, the depth of frequency modulation f1 to f2, f3 to f4 is not constant. The preferred form of the invention has provision for setting modulation amplitude and frequency over a wide range of inverter power while ensuring that a maximum preset level of modulation depth is not exceeded.

A modulating circuit operating in conjunction with the power supply 12 includes a sine wave and other suitable waveforms generator 14 having an adjustable frequency so that the near resonant frequency of the bath can be selected. A meter drive circuit 16 is connected to generator 14 to given an output of standard pulses at the frequency of generator 14 integrated and applied to a moving coil modulation frequency meter 18.

The external controls which can be selectively adjusted manually are a modulating frequency control 20 being a potentiometer for setting the output of generator 14; a modulation amplitude control 22 being a further potentiometer regulating an amplifier and rectifier 24 which receives the output from generator 14 and an on-off selector switch 26 referred to hereafter.

Amplifier and rectifier 24 amplifies and rectifies the output from generator 14 which is then passed to the melting power supply circuit 12 through a voltage controlled oscillator 28 thereof which coacts with the power supply invertor. Oscillator 28 responds to a negative going voltage to generate a function increasing in frequency at its output. Amplifier and rectifier 24 provides amplitudes scaling adjusted by control 22 and its rectifier restricts its output to a positive going wave form which modulates the frequency output of oscillator 28 in a decreasing sense. As illustrated in FIGS. 2*a–c* the power at zero modulation is P2 and the power at maximum modulation is P1.

An indicator lamp 30 is linked to the output from amplifier and rectifier 24 to show when modulation is being applied.

The maximum modulation level is limited by an adjustable potentiometer 32 which will be present and not normally further adjusted. This coacts with a level discriminator 34 which receives the modulated furnace output voltage (indicated diagrammatically by wave form 36 in FIG. 1) by way of a rectifier 38 and amplifier 40 for rectifying and filtering said output voltage. If the amplitude of modulation exceeds the preset value discriminator 34 actuates an excess modulation inhibit device 42 connected to the amplifier and rectifier 24 instantly cutting the output from the latter to zero so that modulation ceases and the indicator lamp 30 will be extinguished. Selector switch 26 operates through inhibit device 42 for manual starting and stopping of the modulation.

A timer device 44 controls the connection between inhibiting device 42 and amplifier and rectifier 24 to provide a reset or startup delay of time T seconds so that application of the modulation is delayed by that period from switch-on or after it has been cut off by the operation of discriminator 34 and inhibiting device 42.

When modulation is first started this allows time for the furnace power frequency to be established so as to avoid any malfunction which might arise from immediate application of the modulation.

It also allows time for adjustment to be made in the amplitude level using control 22 before modulation is re-applied following cutout due to the maximum level being exceeded. If the necessary adjustment is not made the cutout cycle will be repeated. Delay device 44 also includes provision for ramping in the modulation linearly on startup so that modulation is applied gradually.

The frequency modulation so introduced into the medium frequency melting power input enables the degree of agitation or stirring of the melt to be increased without any increase in net power input. Thus the power can be set at a level just sufficient to hold the melt at a constant desired temperature and the degree of agitation is controlled by adjusting the amplitude and/or frequency of the modulation. Thus full and effective stirring is provided without any overheating of the melt.

Figures 3, 4A:
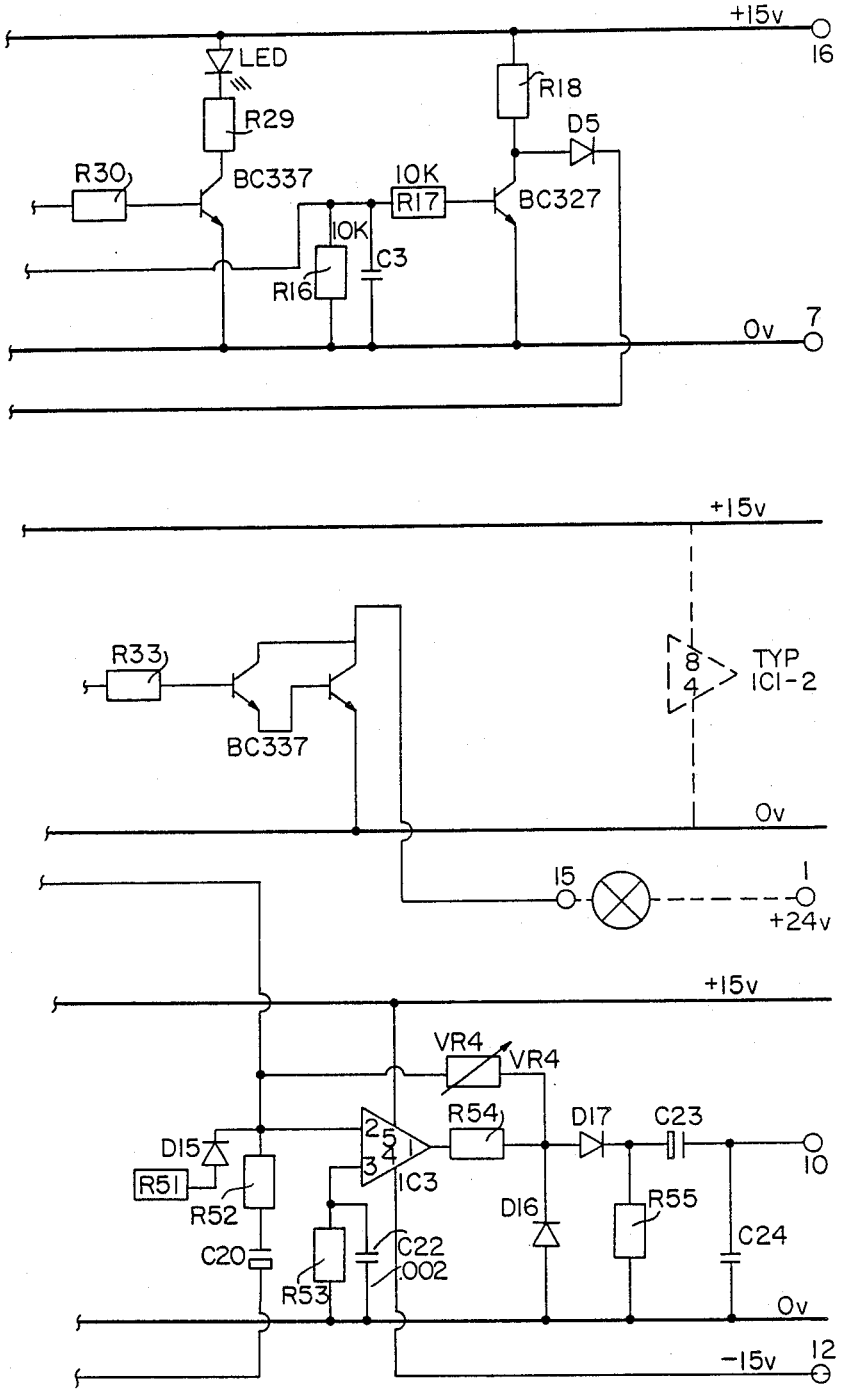

The surface disturbance of the melt with modulation is indicated diagrammatically in FIG. 3(*b*) in comparison with the melt surface shown in FIG. 3(*a*) when there is no modulation. The substantially increased surface area of the melt derived from the increased agitation is beneficial in assisting degassing, again while holding the melt at constant temperature. This is a particular advantage where the furnace is used for a vacuum melting process. However, the invention is also useful for non-vacuum processes e.g. the air melting of steel for recarburising or the melting of other metals and their alloys.

Figure 4B:
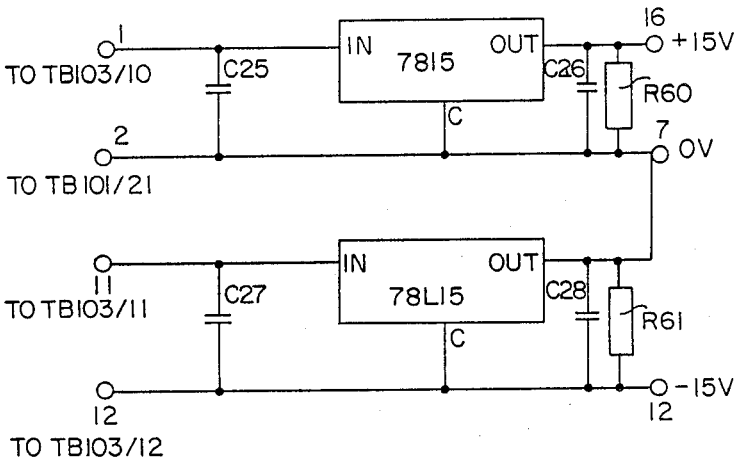

A circuit diagram of an example of modulator means as described above is shown in FIG. 4*a* and of the power supply thereof in FIG. 4*b*.

I claim:

1. A method of inductively stirring molten metal, which comprises the steps of:

(a) inductively heating molten metal in a vessel to a preselected temperature by applying power thereto from a single power supply at a first frequency through an induction coil; and (b) modulating the amplitude of the power to the induction coil with a modulation signal at a second frequency so that the melt is agitated to a predetermined extent independent of a selected overall power input.

2. The method as defined in claim 1, which further comprises the step of adjusting the second frequency to be approximately equal to the hydrodynamic resonant frequency of the metal bath.

3. The method as defined by claim 1, which further comprises the step of gradually applying the modulation.

4. The method as defined by claim 1, which further comprises the step of terminating the modulation when a predetermined maximum modulation level is exceeded.

5. The method as defined by claim 1, which further comprises the step of delaying the inception of modulation until the power from a power supply means has reached a predetermined value.

6. The method as defined by claim 4, which further comprises the step of delaying the inception of modulation after termination of modulation due to exceeding the predetermined maximum modulation level.

7. A method of inductively stirring molten metal, which comprises the steps of:

(a) inductively heating a molten metal bath by applying power thereto from a single power supply at a first frequency through an induction coil;

(b) modulating the amplitude of the power to the induction coil with a modulation signal at a second frequency so that the melt is agitated to a predetermined extent independent of a selected overall power input, wherein the step of modulating includes generating within the single power supply waveforms of a second frequency being approximately equal to the near resonant frequency of the metal bath;

(c) filtering and rectifying the waveform of the second frequency; and (d) applying the filtered and rectified waveform to the induction coil.

8. A method as defined in claim 7, further comprising the step of terminating the modulation when a predetermined maximum modulation level is exceeded.

9. A method as defined in claim 7, further comprising the steps of gradually applying the modulation to the metal bath.

10. A method as defined in claim 7, further comprising the steps of delaying the inception of modulation until the first frequency is established.

11. A method as defined in claim 7, further comprising the step of delaying inception of the modulation signal following termination of modulation due to exceeding the maximum modulation level.

* * * * *